United States Patent [19]

Gordon

[11] 3,941,227

[45] Mar. 2, 1976

[54] COIN BOX MECHANISM

[75] Inventor: Roger G. Gordon, Richmond, Calif.

[73] Assignee: Safe Rack, Inc., San Leandro, Calif.

[22] Filed: Oct. 11, 1974

[21] Appl. No.: 514,009

[52] U.S. Cl. ..... 194/1 K; 194/71

[51] Int. Cl.[2] ..... G07F 11/00

[58] Field of Search ..... 194/54, 71, 78, 79, 80, 194/91, 1 K

[56] References Cited

UNITED STATES PATENTS

| | | | |
|---|---|---|---|
| 2,925,898 | 2/1960 | Terry | 194/54 |
| 3,158,248 | 11/1964 | Hawks | 194/71 |
| 3,174,608 | 3/1965 | Knickerbocker | 194/54 |
| 3,503,482 | 3/1970 | Davis | 194/54 |
| 3,782,518 | 1/1974 | Smith | 194/54 |

*Primary Examiner*—Allen N. Knowles
*Attorney, Agent, or Firm*—Robert G. Slick

[57] ABSTRACT

A coin box mechanism is provided which can be easily set to be actuated by a combination of coins and wherein the combination can be readily changed without the use of tools. The coin box mechanism was particularly designed for use in conjunction with a newspaper rack, but it can be used in a large number of different applications.

7 Claims, 11 Drawing Figures

COIN BOX MECHANISM

SUMMARY OF THE INVENTION

The present invention provides a simple, mechanical coin box mechanism which can be set for a variety of coins. The amount which is required to actuate the mechanism can be changed by a simple operation without the use of tools.

The coin box of the present invention can be provided with a plurality of slots so that coins of different denominations can be employed and each of the slots can be locked out in case a coin of that particular denomination is not required to activate the mechanism.

One feature of the invention is that the coin itself provides the actuating force for connection so that it is impossible to fool the machine into actuation without an actual coin being present.

Another feature of the present invention is that more than one coin of any given denomination may be required to actuate that particular slide. Thus, with amounts such as 20 cents, and assuming that the coin box is equipped to take nickels, dimes and quarters, the nickel and quarter slots could be locked out and the dime slot be set to require two dimes to actuate it.

Another object of the present invention is to provide a simple detection device for counterfeit coins which are undersize or of a magnetic nature.

Various other features of the invention will be brought out in the balance of the specification.

DESCRIPTION OF THE PREFERRED EMBODIMENT

Figure 1:
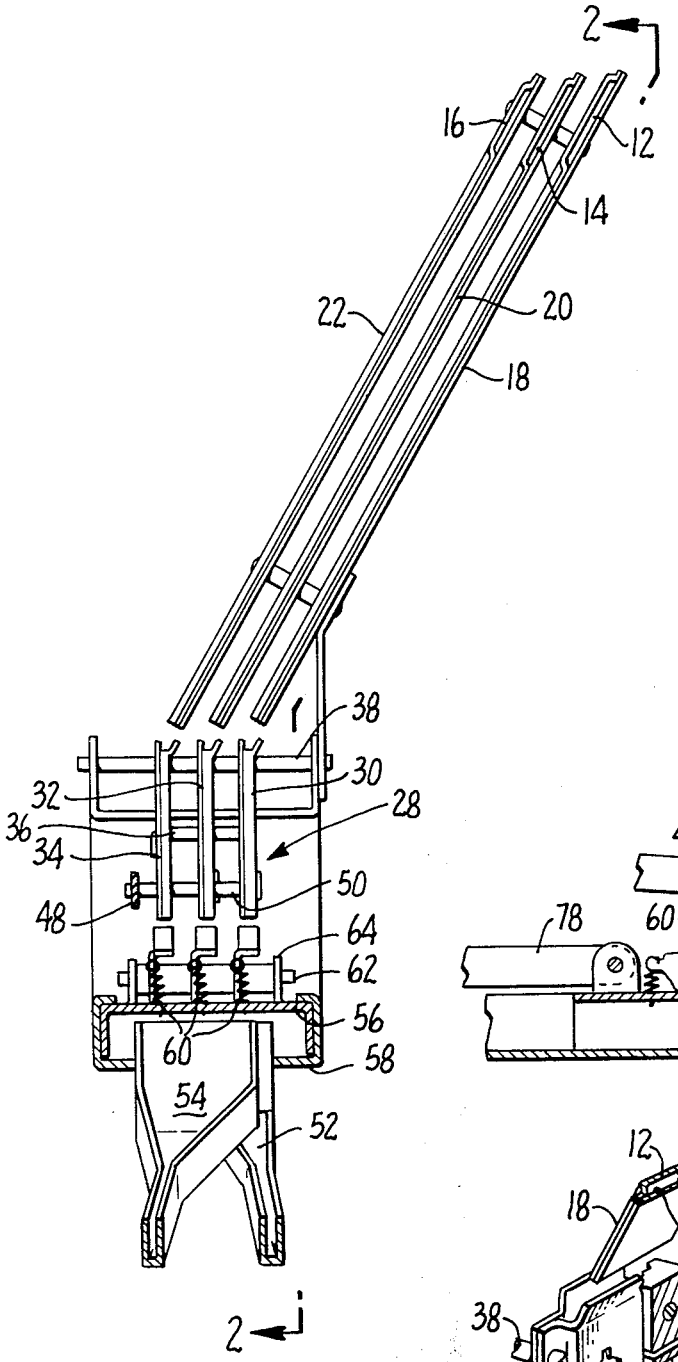
FIG. 1 is a front view, partly in section, of a coin box mechanism embodying the present invention.
Figure 2:
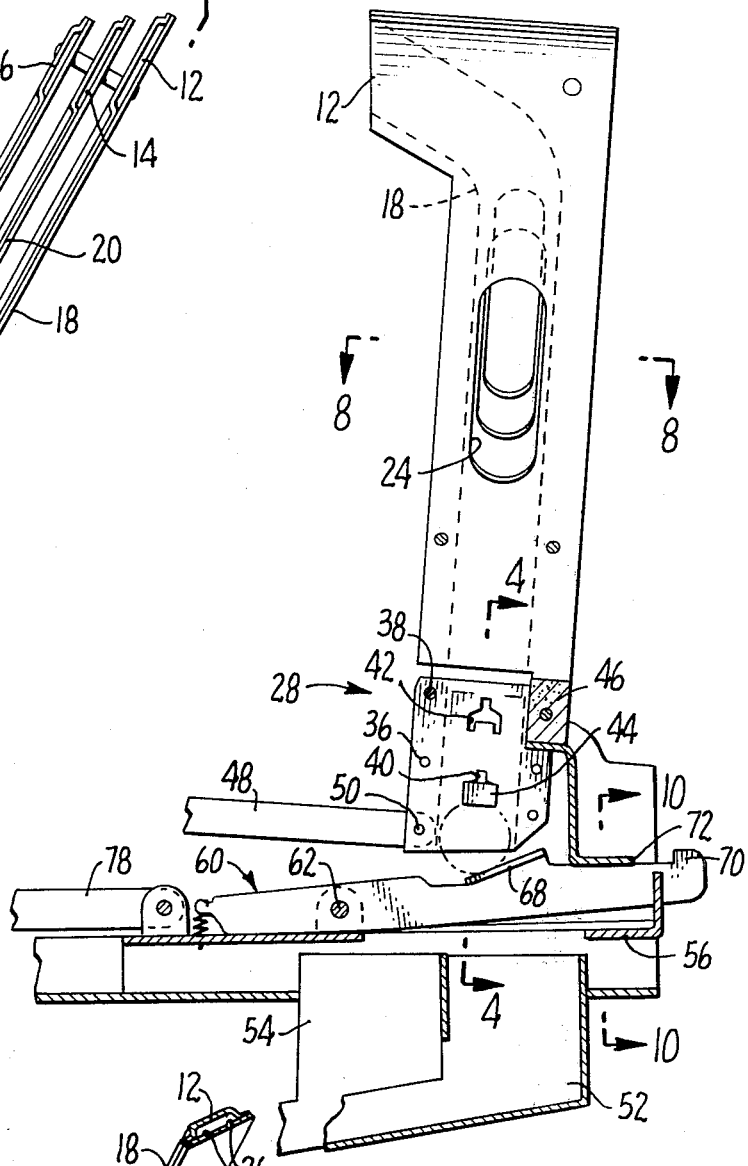
FIG. 2 is a side view on the line 2—2 of FIG. 1.
Figure 3:
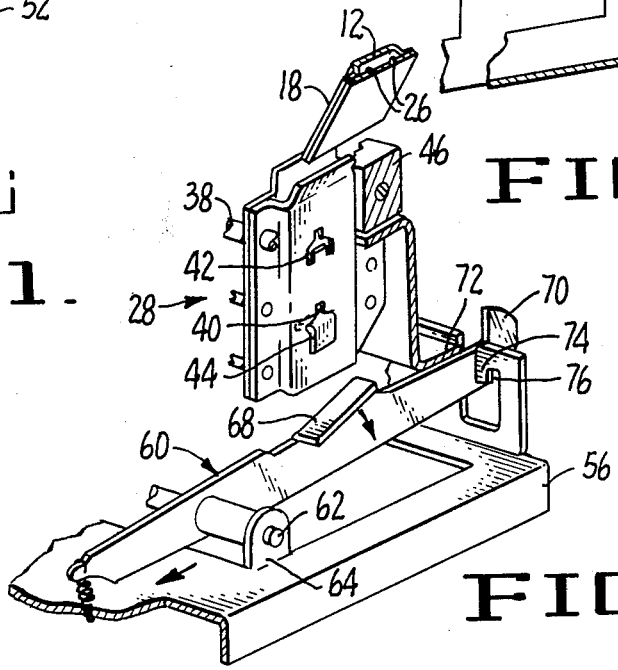
FIG. 3 is an enlarged detail in perspective of the actuating mechanism.
Figure 6:
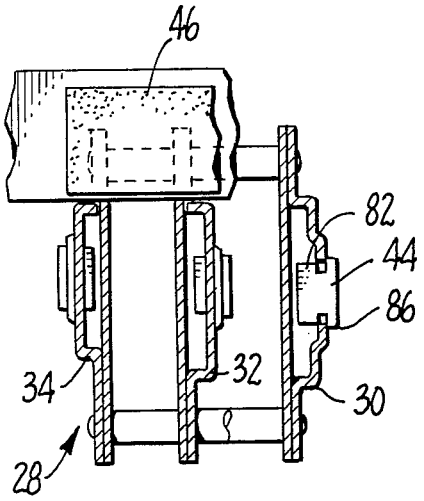
FIG. 6 is a section on the line 6—6 of FIG. 4.

Referring now to the drawings by reference characters, the mechanism includes three slots designated 12, 14 and 16 for the insertion of coins of three different sizes, such as quarters, nickels and dimes. Each of these slots leads to a coin chute 18, 20 and 22. As can best be seen in FIGS. 1 and 2, these chutes lie at an angle, and each of the chutes has a slot therein through which undersize coins can fall. Thus, chute 18 has a slot 24, the slot being slightly smaller than a quarter and having ridges 26 lying on each side of the slot. When a coin is too large, it will not go into the slot, and if it is too small, it will fall out of the slot. Coins of the proper size will enter the slot and will ride over the opening 24 on the ridges 26. The ridges 26 on which the coins ride prevent coins from sticking to the side of the chute if they are moist. The chute for the largest size coin is on the bottom, the chute for middle size coin next, and for the smallest on top. Assuming the slots are for quarters, nickels and dimes, an undersize dime would fall out of its slot and then through the larger nickel and quarter slots. At the end of the coin chutes is located the coin receiving mechanism generally designated 28 and this includes three slotted members 30, 32 and 34 mounted on frame 36 which is pivoted to tilt on rod 38. The three mechanisms are substantially the same, except for size, and each consists of a generally rectangular chamber having slots 40 and 42 on one side thereof. An L-shaped member 44 can fit in either of the slots as is later explained in detail. A magnet is located near the top of the coin receiving mechanism. A pull rod 48 is connected to pin 50 which links the bottom portion of the coin receiving mechanism 28 together. Directly under the slots are two coin hoppers 52 and 54. Hopper 52 is for good coins which have been used to actuate the mechanism, while hopper 54 is for defective coins which are to be returned to the prospective purchaser.

Mounted under the coin mechanism is a sliding framework 56 which is adapted to slide within a passage formed by frame members 58. The sliding frame 56 carries three lever mechanisms generally designated 60, there being one such mechanism for each of the coin slots. The lever mechanism is pivoted on pin 62 passing through ears 64 in the frame 56. The lever itself includes a forward portion which is biased downwardly by a spring 66. The rear has a ramp or cam surface 68 formed thereon which is directly under the bottom of the coin receiver 28. At the rear is a latch member 70 which normally engages on wall 72 preventing the assembly from moving forward. Sliding frame 56 carries a hook member 74 which has a slot 76 in which the lever can be placed if it is desired to lock out that particular denomination. In this position, latch 70 will clear wall 72 permitting slide 56 to move forward. Should a coin be dropped by accident into a slot which is locked out, it will bounce off of the ramp 68 and into the coin return hopper 54.

Frame 56 is connected to lever 78 which extends through the front of the machine and which would normally be supplied with a handle, not shown. Lever 78 would ordinarily be connected to some form of dispensing or latching mechanism so that when the lever 78 is pulled forward, merchandise is dispensed, a door is unlatched, or the like. As the frame 56 moves forward, ramp 68 eventually moves beyond the coin(s) and the coin(s) fall into hopper 52.

Figure 4:
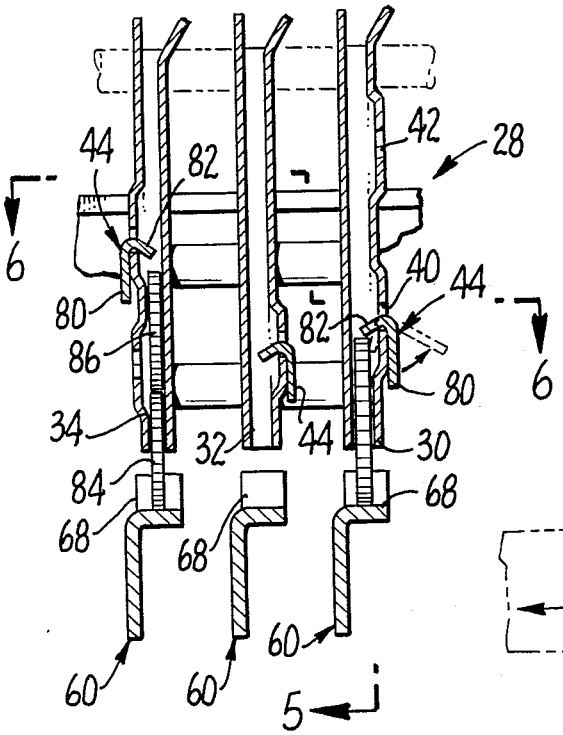
FIG. 4 is an enlarged section on the line 4—4 of FIG. 2.
Figure 5:
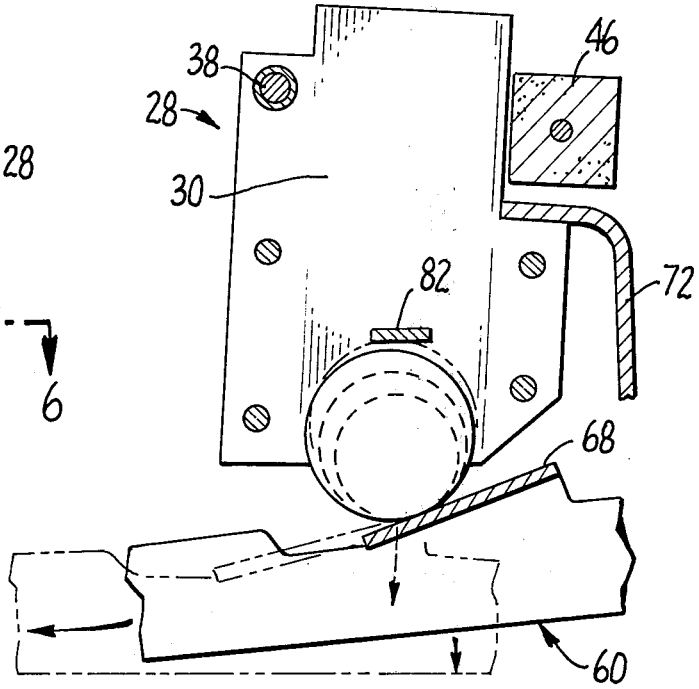
FIG. 5 is a view on the line 5—5 of FIG. 4.
Figure 8:
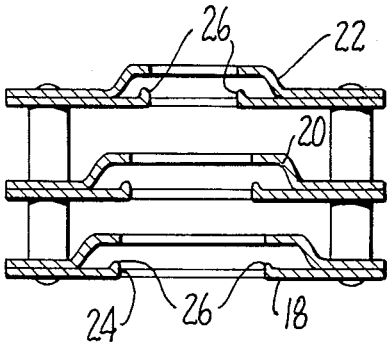
FIG. 8 is a section on the line 8—8 of FIG. 2.
Figure 9:
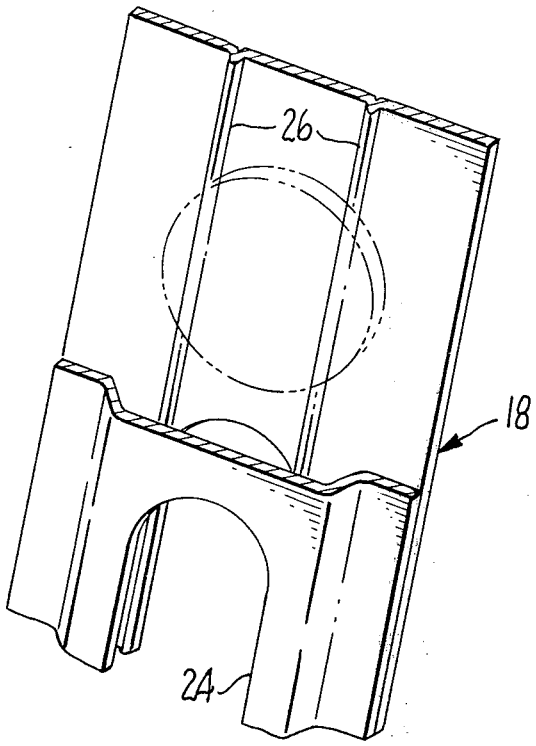
FIG. 9 is an enlarged perspective view of a portion of a coin slot.
Figure 10:
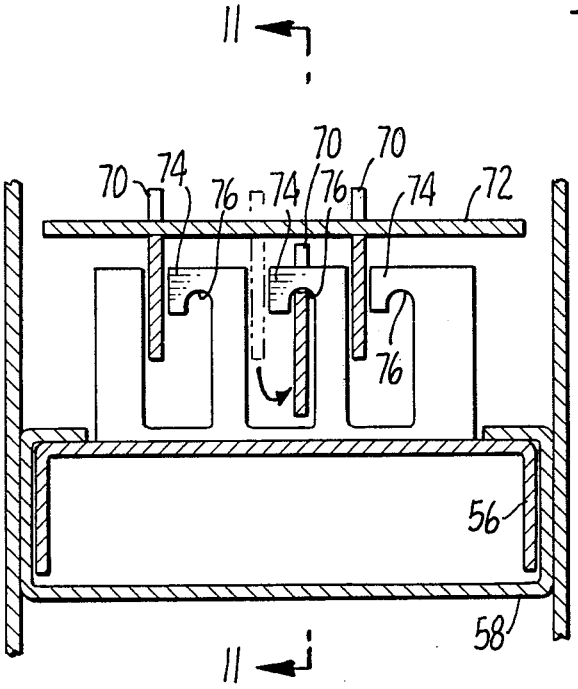
FIG. 10 is a section on the line 10—10 of FIG. 2.
Figure 11:
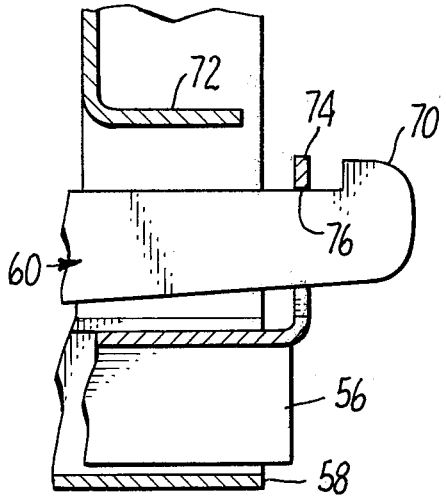
FIG. 11 is a section on the line 11—11 of FIG. 10.

It was previously mentioned that the member 44 can be placed in one of the slots 40 or 42. The function of these parts is best seen by reference to FIG. 4. The members 44 are generally L-shaped with a rather long arm 80 and a short arm 82 with the two sections forming an angle of about 45° with each other. The weight of the long arm normally maintains the member with the long arm in a vertical position, but if a coin drops on top of the short arm 82, the short arm tilts inwardly allowing the coin to pass as it shown in dot/dash lines on the right hand side of FIG. 4. After the coin has cleared the short arm 82, gravity returns the member to the position shown in solid lines of FIG. 4. In this position, a coin under the arm 82 is trapped and cannot move upwardly. It is necessary that a coin be retained in a down position in order to actuate the mechanism as is later explained in detail. If only a single coin is required in a particular slot, the member 44 is placed in the lower slot, which if two coins are required, the member is placed in the upper slot. Thus, referring to the left hand side of FIG. 4, it will be seen that there are two coins 84 and 86 in the slot. Since there are two coins, the coins are locked in place by the short arm 82 which is in the upper slot. On the right hand side of FIG. 4, the member 44 is in the lower slot, so that a single coin is trapped. Of course, if only one coin were placed in the slot on the left, there would be nothing to prevent the coin from moving upwardly.

The individual parts having been described, the overall operation of the device will now be described in detail. Assuming that all three coin slots are to be in operation and that only a single coin will be required in each slot, all of the lever arms would be out of the hooks 74 and the members 44 would all be in the lower slots. Now, if the proper combination of coins is dropped in the slots, one coin in each of the slots will be engaged by the short arm 82 extending into each slot. Since the coins will all be trapped and cannot move upwardly, as one now pulls forward on the arm 78, the coins will push downwardly on ramp 68 so that latch 70 will clear wall 72. As the slide moves forward, each coin will eventually go off of the back of ramp 68 and into the coin hopper 52. At this time, the merchandise would be dispensed and a spring (not shown) would restore the parts to their former position for a repetition of the cycle.

If the particular item being dispensed requires two coins of one denomination, naturally the member 44 would be moved to the upper slot for the particular denomination, and it would require two coins in this slot to work the mechanism. If no coin of a particular denomination were required, the lever arm for that particular denomination would be engaged by hook 76 so that a coin of that particular denomination would not be required to permit member 56 to slide forward, assuming of course, that the proper coins were in the other slots.

Figure 7:
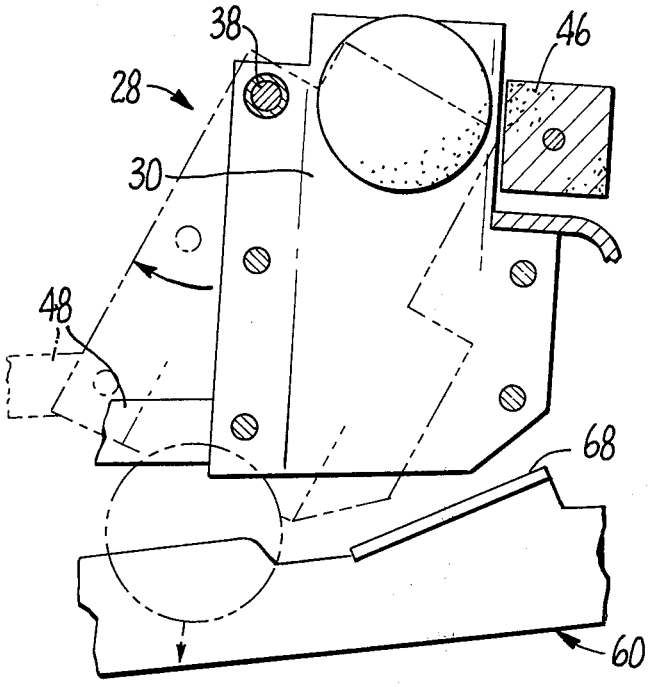
FIG. 7 is a view, similar to 5, showing operation with a magnetic coin.

At any time prior to the actuation of the sliding member 56 by means of arm 78, one can move the arm 48 to tilt the coin receiver as is shown in dot/dash lines in FIG. 7. If one or more of the coins is magnetic and would be retained on the magnet 46, moving the receiver forward by means of lever 48 moves the coin sufficiently far from the magnet to break the magnetic attraction, allowing it to be returned. Thus, if one used two good coins and one magnetic coin, one could not pull the arm 78 and obtain the merchandise, but one could pull on arm 48 and return all of the coins, both good and bad.

It has been assumed throughout the specification that three coin slots and operating mechanisms would be provided. This is for illustrative purposes only, and a device could be made to actuate with a single coin or two coins or a number of coins greater than three.

Many variations can be made in the exact structure shown without departing from the spirit of this invention.

I claim:

1. A coin operated mechanism wherein a coin of a proper denomination will release said mechanism, comprising in combination:

a. slot means for receiving a coin and passing the coin downward into coin receiver means, b. said coin receiver means having spaced parallel sidewalls, said walls being spaced by an amount slightly greater than the thickness of a coin destined to pass through said coin receiver, c. at least one generally horizontal slot in a wall of said coin receiver, d. a U-shaped member adapted to fit into said horizontal slot, said U-shaped member having a long side and a short side and having an included angle of about 45 degrees whereby said member can be placed in said horizontal slot with the small end inside said receiver whereby the long end will hang by gravity parallel to and adjacent said wall with the small end protruding into the coin space between the walls, e. said U-shaped member being adapted to tilt and allow a coin to pass through said coin receiver and being restored to its former position by gravity so that a coin cannot move upwardly within the receiver, f. a slide mechanism mounted under said coin receiving means, said slide including a pivoted lever, said lever having a cam surface disposed under said coin receiver, g. said pivoted lever having a latch member normally blased in locked position, h. said cam surface being adapted to contact a coin held in said coin receiving means and to move said pivoted lever downwardly by the action of said coin on said cam when said slide member is moved forward, whereby said pivoted lever is released by said latching member, permitting said slide to move forward.

2. The structure of claim 1 wherein said coin receiver includes a magnetic coin holding device, whereby a magnetic coin is prevented from moving down into contact with said cam surface.

3. The structure of claim 1 wherein said slot means has an opening therein whereby an undersized coin will fall through said opening.

4. The structure of claim 1 wherein said slot means includes ridges on which coins can slide.

5. The structure of claim 1 wherein said coin receiving means is provided with tilting means for moving said coin receiving means to a position whereby coins are discharged into a coin return hopper.

6. The structure of claim 1 wherein the coin receiving means has first and second slots in the sides thereof with a coin locking means which can be selectively placed in one of said slots whereby either one or two coins can be required to operate the mechanism.

7. The structure of claim 1 wherein said pivoted lever is provided with a lock out means whereby said lever is rendered inoperative.

* * * * *